US007614336B2

(12) United States Patent
VerKuilen et al.

(10) Patent No.: US 7,614,336 B2
(45) Date of Patent: Nov. 10, 2009

(54) HYDRAULIC SYSTEM HAVING AUGMENTED PRESSURE COMPENSATION

(75) Inventors: Michael Todd VerKuilen, Metamora, IL (US); Jeffrey Lee Kuehn, Metamora, IL (US); Srinivas Kowta, Sullurpet (IN); Eko A. Prasetiawan, Dunlap, IL (US); Shoji Tozawa, Peoria, IL (US)

(73) Assignees: Caterpillar Inc., Peoria, IL (US); Shin Caterpillar Mitsubishi Ltd (JP)

( * ) Notice: Subject to any disclaimer, the term of this patent is extended or adjusted under 35 U.S.C. 154(b) by 0 days.

(21) Appl. No.: 11/238,962

(22) Filed: Sep. 30, 2005

(65) Prior Publication Data

US 2007/0074510 A1 Apr. 5, 2007

(51) Int. Cl.
*F15B 13/08* (2006.01)

(52) U.S. Cl. ..... 91/446; 91/454

(58) Field of Classification Search ..... 91/446, 91/454

See application file for complete search history.

(56) References Cited

U.S. PATENT DOCUMENTS

| | | | |
|---|---|---|---|
| 3,366,202 | A | 1/1968 | James |
| 3,590,861 | A | 7/1971 | Chittenden et al. |
| 4,046,270 | A | 9/1977 | Baron et al. |
| 4,222,409 | A | 9/1980 | Budzich |
| 4,250,794 | A | 2/1981 | Haak et al. |
| 4,416,187 | A | 11/1983 | Nystrom |
| 4,437,385 | A | 3/1984 | Kramer et al. |
| 4,440,191 | A | 4/1984 | Hansen |
| 4,480,527 | A | 11/1984 | Lonnemo |
| 4,581,893 | A | 4/1986 | Lindbom |
| 4,586,330 | A | 5/1986 | Watanabe et al. |
| 4,623,118 | A | 11/1986 | Kumar |
| 4,662,601 | A | 5/1987 | Andersson |
| 4,706,932 | A | 11/1987 | Yoshida et al. |
| 4,747,335 | A | 5/1988 | Budzich |
| 4,799,420 | A | 1/1989 | Budzich |
| 5,137,254 | A | 8/1992 | Aardema et al. |
| 5,152,142 | A | 10/1992 | Budzich |
| 5,211,196 | A | 5/1993 | Schwelm |
| 5,287,794 | A | 2/1994 | Andersson |
| 5,297,381 | A | 3/1994 | Eich et al. |
| 5,313,873 | A | 5/1994 | Gall et al. |

(Continued)

FOREIGN PATENT DOCUMENTS

| | | |
|---|---|---|
| DE | 3813020 | 11/1989 |

(Continued)

*Primary Examiner*—F. Daniel Lopez
(74) *Attorney, Agent, or Firm*—Finnegan, Henderson, Farabow, Garrett & Dunner

(57) ABSTRACT

A hydraulic system is disclosed having a source of pressurized fluid, at least a one hydraulic actuator, and a first valve. The first valve has a first valve element movable relative to a first valve bore between a plurality of positions from a first position in which pressurized fluid is substantially blocked from flowing toward the at least one hydraulic actuator to a second position in which pressurized fluid is allowed to flow toward the at least one hydraulic actuator. The first valve element is configured to be selectively moved from a third position located between the first and second positions to a fourth position located between the third and second positions at least partially based on a pressure signal of pressurized fluid downstream of the first valve.

6 Claims, 3 Drawing Sheets

U.S. PATENT DOCUMENTS

| | | | | |
|---|---|---|---|---|
| 5,333,449 | A * | 8/1994 | Takahashi et al. | 60/452 |
| 5,350,152 | A | 9/1994 | Hutchison et al. | |
| 5,366,202 | A | 11/1994 | Lunzman | |
| 5,428,958 | A * | 7/1995 | Stenlund | 91/435 |
| 5,447,093 | A | 9/1995 | Budzich | |
| 5,477,677 | A | 12/1995 | Kmavek | |
| 5,537,818 | A | 7/1996 | Hosseini et al. | |
| 5,553,452 | A | 9/1996 | Snow et al. | |
| 5,568,759 | A | 10/1996 | Aardema | |
| 5,678,470 | A | 10/1997 | Koehler et al. | |
| 5,701,933 | A | 12/1997 | Lunzman | |
| 5,813,226 | A | 9/1998 | Krone | |
| 5,813,309 | A | 9/1998 | Taka et al. | |
| 5,857,330 | A | 1/1999 | Ishizaki et al. | |
| 5,868,059 | A | 2/1999 | Smith | |
| 5,878,647 | A | 3/1999 | Wilke et al. | |
| 5,890,362 | A | 4/1999 | Wilke | |
| 5,896,737 | A | 4/1999 | Dyer | |
| 5,947,140 | A | 9/1999 | Aardema et al. | |
| 5,960,695 | A | 10/1999 | Aardema et al. | |
| 6,009,708 | A | 1/2000 | Miki et al. | |
| 6,026,730 | A | 2/2000 | Yoshida et al. | |
| 6,082,106 | A | 7/2000 | Hamamoto | |
| 6,216,456 | B1 | 4/2001 | Mitchell | |
| 6,367,365 | B1 | 4/2002 | Weickert et al. | |
| 6,381,946 | B1 | 5/2002 | Wernberg et al. | |
| 6,446,433 | B1 | 9/2002 | Holt et al. | |
| 6,467,264 | B1 | 10/2002 | Stephenson et al. | |
| 6,502,393 | B1 | 1/2003 | Stephenson et al. | |
| 6,502,500 | B2 | 1/2003 | Yoshino | |
| 6,516,614 | B1 | 2/2003 | Knoll | |
| 6,598,391 | B2 | 7/2003 | Lunzman et al. | |
| 6,619,183 | B2 | 9/2003 | Yoshino | |
| 6,655,136 | B2 | 12/2003 | Holt et al. | |
| 6,662,705 | B2 | 12/2003 | Huang et al. | |
| 6,691,603 | B2 | 2/2004 | Linerode et al. | |
| 6,694,860 | B2 | 2/2004 | Yoshino | |
| 6,715,402 | B2 | 4/2004 | Pfaff et al. | |
| 6,715,403 | B2 | 4/2004 | Hajek, Jr. et al. | |
| 6,718,759 | B1 | 4/2004 | Tabor | |
| 6,725,131 | B2 | 4/2004 | Lunzman | |
| 6,732,512 | B2 | 5/2004 | Pfaff et al. | |
| 6,748,738 | B2 | 6/2004 | Smith | |
| 6,761,029 | B2 | 7/2004 | Linerode | |
| 2003/0106423 | A1 | 6/2003 | Hajek, Jr. et al. | |
| 2003/0121256 | A1 | 7/2003 | Mather | |
| 2003/0121409 | A1 | 7/2003 | Lunzman et al. | |
| 2003/0125840 | A1 | 7/2003 | Lunzman et al. | |
| 2003/0196545 | A1 | 10/2003 | Jensen et al. | |
| 2004/0055288 | A1 | 3/2004 | Pfaff et al. | |
| 2004/0055289 | A1 | 3/2004 | Pfaff et al. | |
| 2004/0055452 | A1 | 3/2004 | Tabor | |
| 2004/0055453 | A1 | 3/2004 | Tabor | |
| 2004/0055454 | A1 | 3/2004 | Pfaff et al. | |
| 2004/0055455 | A1 * | 3/2004 | Tabor et al. | 91/433 |
| 2006/0191262 | A1 | 8/2006 | Jackson et al. | |

FOREIGN PATENT DOCUMENTS

| | | |
|---|---|---|
| EP | 1152155 | 11/2001 |
| EP | 1 538 361 | 6/2005 |
| JP | 02613041 B2 | 5/1997 |
| JP | 10306677 | 11/1998 |

* cited by examiner

HYDRAULIC SYSTEM HAVING AUGMENTED PRESSURE COMPENSATION

TECHNICAL FIELD

The present disclosure relates generally to a hydraulic system, and more particularly, to a hydraulic system having augmented pressure compensation.

BACKGROUND

Hydraulic systems are often used to control the operation of hydraulic actuators of work machines. These hydraulic systems typically include valves, arranged within hydraulic circuits, fluidly connected between the actuators and pumps. These valves may each be configured to control a flow rate and direction of pressurized fluid to or from respective chambers within the actuators. In some instances, multiple actuators may be connected to a common pump. Actuation of one such actuator may cause undesirable pressure fluctuations within one or more of the hydraulic circuits fluidly connected to the common pump. Also, actuation of one actuator may require a significantly higher pressure from the pump than actuation of other actuators either independently or simultaneously.

One method of reducing pressure fluctuations in hydraulic systems is described in U.S. Pat. No. 5,878,647 ("the '647 patent") issued to Wilke et al. The '647 patent describes a hydraulic circuit having two pairs of solenoid valves, a variable displacement pump, a reservoir, and a hydraulic actuator. One pair of solenoid valves includes a head-end supply valve and a head-end return valve and connects a head-end chamber of the hydraulic actuator to either the variable displacement pump or the reservoir. The other pair of solenoid valves includes a rod-end supply valve and a rod-end return valve and connects a rod-end chamber of the hydraulic actuator to either the variable displacement pump or the reservoir. Each of the four solenoid valves is associated with a different pressure compensating valve to control a pressure of fluid between the associated valve and the actuator.

Although the multiple pressure compensating valves of the hydraulic circuit described in the '647 patent may reduce pressure fluctuations within the hydraulic circuit, they may establish high pressure drops when reducing the output pressure of the pump to the desired pressure for actuation of the hydraulic actuator. These high pressure drops may be unnecessary to operate the hydraulic actuator as desired, and may reduce the available flow of pressurized fluid by unnecessarily establishing a high output pressure of the pump, and/or may reduce the efficiency of the hydraulic circuit by requiring unnecessary energy from a power source operably driving the pump. Additionally, because the hydraulic circuit may have a plurality of hydraulic actuators, the actuator that establishes the highest output pressure from the pump may change depending on external loads on the plurality of actuators and/or operator inputs. As such, a system configured to lower pressure requirements may need to be flexible to adjust to the changing external loads and/or operator inputs.

The disclosed hydraulic system is directed to overcoming one or more of the problems set forth above.

SUMMARY OF THE INVENTION

In one aspect, the present disclosure is directed to a hydraulic system including a source of pressurized fluid, at least a one hydraulic actuator, and a first valve. The first valve has a first valve element movable relative to a first valve bore between a plurality of positions from a first position in which pressurized fluid is substantially blocked from flowing toward the at least one hydraulic actuator to a second position in which a maximum flow of pressurized fluid is allowed to flow toward the at least one hydraulic actuator. The first valve element is configured to be selectively moved from a third position located between the first and second positions to a fourth position located between the third and second positions at least partially based on a pressure signal of pressurized fluid downstream of the first valve.

In another aspect, the present disclosure is directed to a method of operating a hydraulic system including pressurizing a fluid and directing pressurized fluid toward a first valve. The method also includes directing a first flow of pressurized fluid at a first pressure from the first valve to a first chamber of a first hydraulic actuator. The method further includes directing a second flow of pressurized fluid at a second pressure from the first valve to the first chamber at least partially based on a pressure downstream of the first valve, wherein the first pressure is greater than the second pressure.

DETAILED DESCRIPTION

Figure 1:
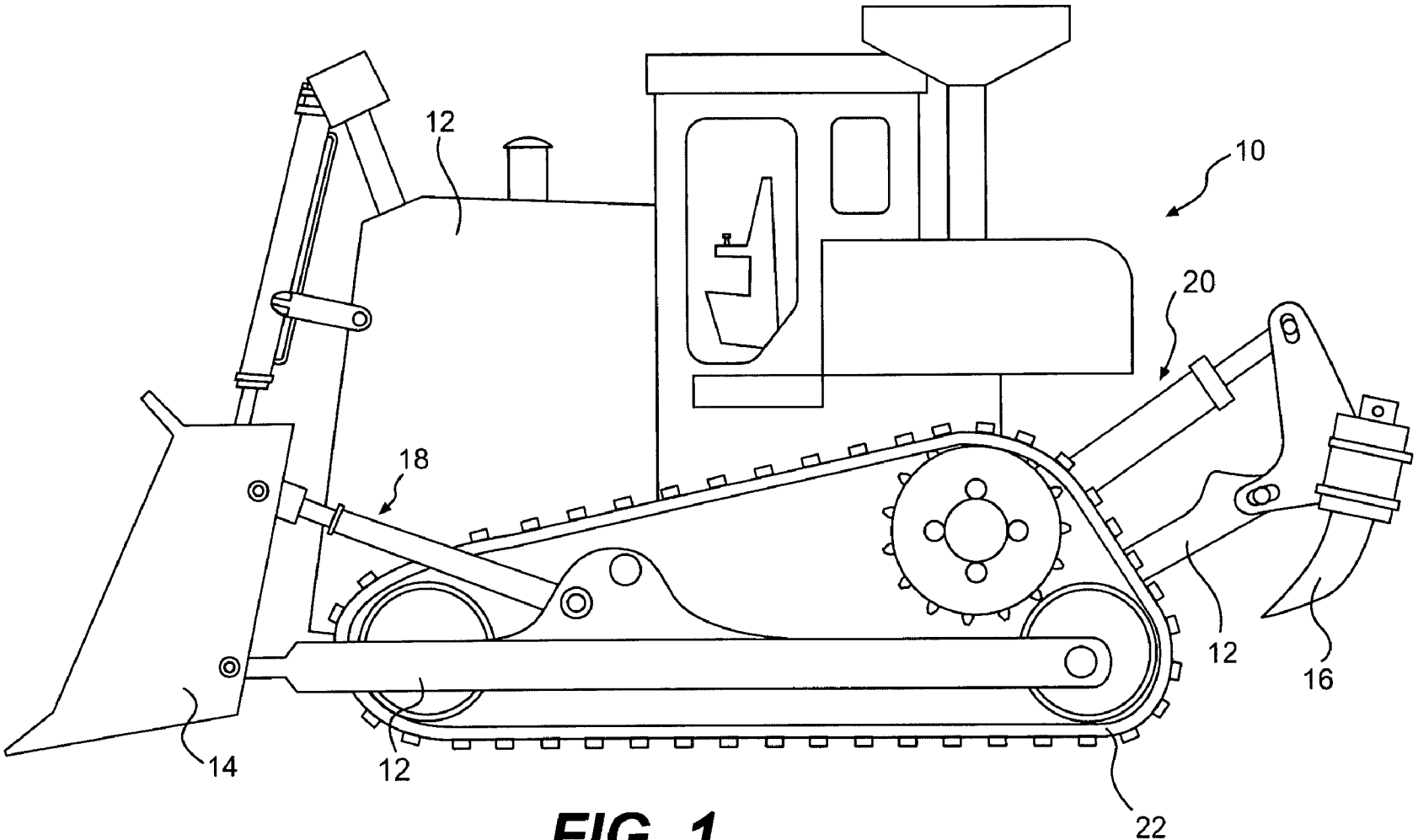
FIG. 1 is a diagrammatic illustration of an exemplary disclosed work machine.

FIG. 1 illustrates an exemplary work machine 10. Work machine 10 may be a fixed or mobile machine that performs some type of operation associated with an industry such as mining, construction, farming, or any other industry known in the art. For example, work machine 10 may be an earth moving machine such as a dozer, a loader, a backhoe, an excavator, a motor grader, a dump truck, or any other earth moving machine. Work machine 10 may also include a generator set, a pump, a marine vessel, or any other suitable operation-performing machine. Work machine 10 may include a frame 12, first and second work implements 14, 16, and first and second hydraulic actuators 18, 20 connected between first and second work implements 14, 16 and/or frame 12.

Frame 12 may include any structural unit that supports work machine 10. Frame 12 may be, for example, a stationary base frame connecting a power source (not shown) to a traction device 22, a movable frame member of a linkage system, and/or any other type of frame known in the art.

First and second work implements 14, 16 may each include any device used in the performance of a task. For example, first and second work implements 14, 16 may include a blade, a ripper, a bucket, a shovel, a dump bed, a propelling device, or any other task-performing device known in the art. First and second work implements 14, 16 may be connected to frame 12 via a direct pivot, via a linkage system with one of hydraulic actuators 18, 20 forming a member in the linkage system, and/or in any other appropriate manner. First and second work implements 14, 16 may be configured to pivot, rotate, slide, swing, or move relative to frame 12 in any other manner known in the art.

Figure 2:
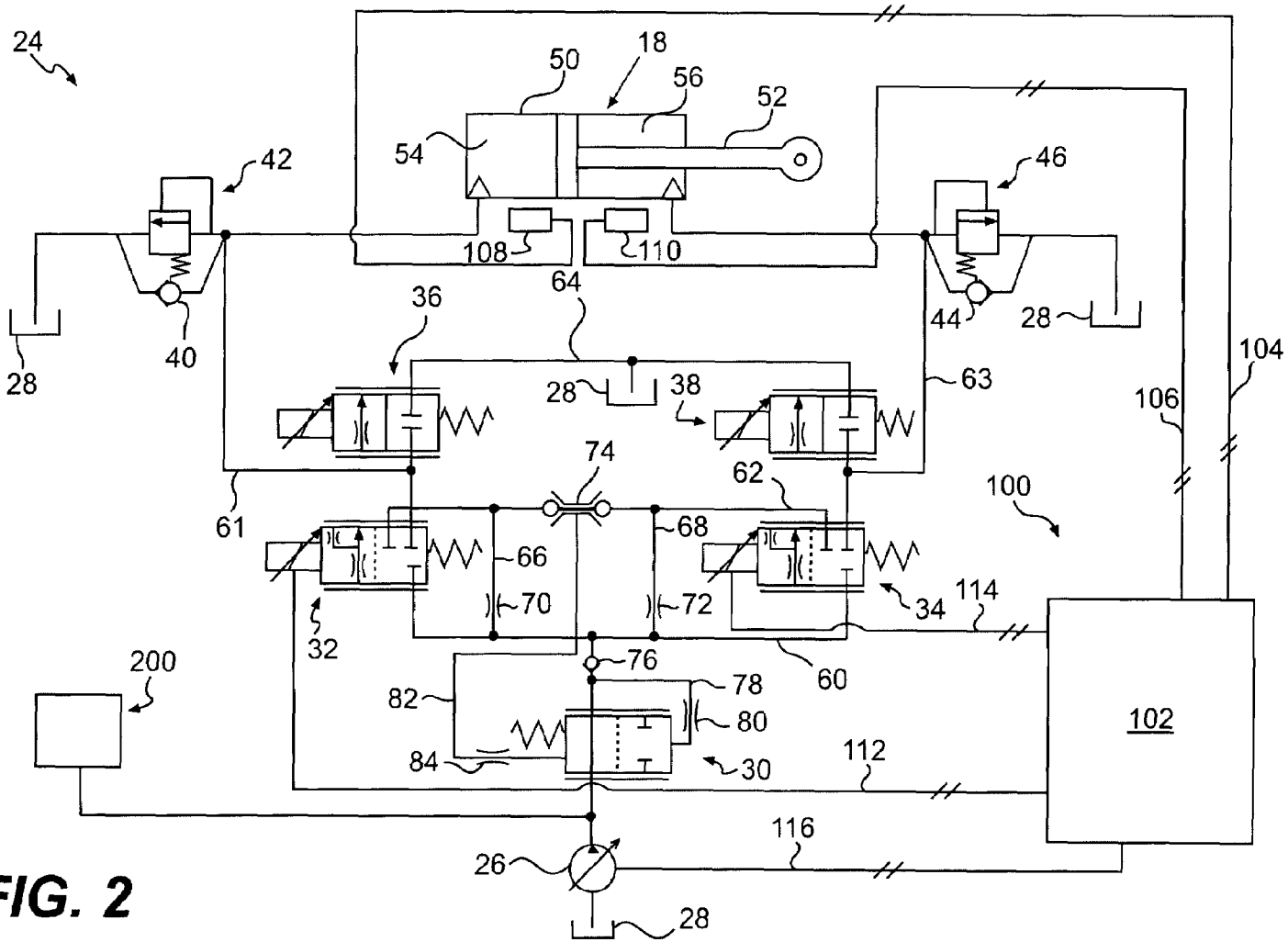
FIG. 2 is a schematic illustration of an exemplary disclosed hydraulic system of the work machine of FIG. 1.

As illustrated in FIG. 2, work machine 10 may further include a hydraulic system 24 configured to affect movement of one or both of first and second hydraulic actuators 18, 20 so as to move, for example, one or both of first and second work implements 14, 16. For clarification purposes, hydraulic system 24 will be described with reference to a hydraulic circuit configured to control the operation of first hydraulic actuator 18. It is noted however, that hydraulic system 24 may include additional hydraulic circuits 200 to actuate second hydraulic actuator 20 and/or additional hydraulic actuators.

Hydraulic system 24 may include a source 26 of pressurized fluid, a tank 28, a pressure compensating valve 30, a head-end supply valve 32, a rod-end supply valve 34, a head-end drain valve 36, and a rod-end drain valve 38. Hydraulic system 24 may also include head-end make-up valve 40, head-end relief valve 42, rod-end make-up valve 44, and rod-end relief valve 46. It is contemplated that hydraulic system 24 may include additional and/or different components such as, for example, a temperature sensor, a position sensor, an accumulator, and/or other components known in the art.

First hydraulic actuator 18 may include a piston-cylinder arrangement, a hydraulic motor, and/or any other known hydraulic actuator having one or more fluid chambers therein. For example, first hydraulic actuator 18 may include a tube 50 and a piston assembly 52 disposed within tube 50. One of tube 50 and piston assembly 52 may be pivotally connected to frame 12, while the other of tube 50 and piston assembly 52 may be pivotally connected to work implement 14. First hydraulic actuator 18 may include a first chamber 54 (head-end chamber) and a second chamber 56 (rod-end chamber) separated by piston assembly 52. The first and second chambers 54, 56 may be selectively supplied with pressurized fluid to cause piston assembly 52 to displace within tube 50, thereby changing the effective length of first hydraulic actuator 18. The expansion and retraction of first hydraulic actuator 18 may function to assist in moving one or both of frame 12 and work implement 14. It is contemplated that first hydraulic actuator 18 may be connected to and/or between any components of work machine 10 to affect relative movement therebetween.

Displacement of piston assembly 52 may be caused by a pressure differential acting across opposite sides of piston assembly 52. An imbalance of forces may be caused by fluid pressure within one of first and second chambers 54, 56 being different than fluid pressure within the other one of first and second chambers 54, 56. For example, a pressure on a first chamber surface of piston assembly 52 being greater than a pressure on a second chamber surface of piston assembly 52 may cause piston assembly 52 to displace to increase the effective length of first hydraulic actuator 18. Similarly, a pressure on the second chamber surface of piston assembly 52 being greater than a pressure on the first chamber surface of piston assembly 52 may cause retraction of piston assembly 52 within tube 50 to decrease the effective length of first hydraulic actuator 18. It is contemplated that a sealing member (not shown), such as an o-ring, may be connected to piston assembly 52 to restrict a flow of fluid between the first and second chambers 54, 56.

Source 26 may be configured to produce a flow of pressurized fluid and may include a variable displacement pump such as, for example, a swashplate pump, a variable pitch propeller pump, and/or other sources of pressurized fluid known in the art. Source 26 may be controlled by a control system 100 and may be drivably connected to a power source (not shown) of work machine 10 by, for example, a countershaft (not shown), a belt (not shown), an electrical circuit (not shown), and/or in any other suitable manner. Source 26 may be disposed between tank 28 and first hydraulic actuator 18 and may be configured to be controlled by a control system 100. Source 26 may be dedicated to supplying pressurized fluid only to hydraulic system 24, or alternately may supply pressurized fluid to additional hydraulic systems, such as, for example, lubricating systems within work machine 10.

Tank 28 may include any low pressure source known in the art, such as, for example, a reservoir configured to hold a supply of fluid. The fluid may include, for example, a dedicated hydraulic oil, an engine lubrication oil, a transmission lubrication oil, or any other working fluid known in the art. One or more hydraulic systems within work machine 10 may draw fluid from and return fluid to tank 28. It is also contemplated that hydraulic system 24 may be connected to multiple, separate fluid tanks.

Pressure compensating valve 30 may be a proportional control valve disposed between source 26 and an upstream supply passageway 60 and may be configured to control a pressure of the fluid supplied to upstream supply passageway 60. Pressure compensating valve 30 may include a proportional valve element that may be spring and hydraulically biased toward a flow passing position and hydraulically biased toward a flow blocking position. The proportional valve element of pressure compensating valve 30 may be displaced relative to a valve body in response to a resulting balance of spring and hydraulic forces.

Pressure compensating valve 30 may be movable toward the flow blocking position by a fluid directed via a fluid passageway 78 from a point between pressure compensating valve 30 and upstream supply passageway 60. A restrictive orifice 80 may be disposed within fluid passageway 78 to minimize pressure and/or flow oscillations within fluid passageway 78. Pressure compensating valve 30 may be movable toward the flow passing position by a fluid directed via a fluid passageway 82 from a shuttle valve 74. A restrictive orifice 84 may be disposed within fluid passageway 82 to minimize pressure and/or flow oscillations within fluid passageway 82. It is contemplated that the proportional valve element of pressure compensating valve 30 may alternately be spring biased toward a flow blocking position, that the fluid from passageway 82 may alternately bias the valve element of pressure compensating valve 36 toward the flow blocking position, and/or that the fluid from passageway 78 may alternately move the proportional valve element of pressure compensating valve 30 toward the flow passing position. It is also contemplated that pressure compensating valve 30 may alternately be located downstream of head-end and rod-end supply valves 32, 34 or in any other suitable location. It is further contemplated that restrictive orifices 80 and 84 may be omitted, if desired.

Head-end and rod-end supply valves 32, 34 may be disposed between source 26 and first hydraulic actuator 18 and may be configured to regulate a flow of pressurized fluid to first and second chambers 54, 56, respectively. Specifically, head-end and rod-end supply valves 32, 34 may each include a proportional valve element that may be spring biased and solenoid actuated to move the valve element to any of a plurality of positions from a first position in which fluid flow may be substantially blocked from flowing toward first and second chambers 54, 56 to a second position in which a maximum fluid flow may be allowed toward flow to first and second chambers 54, 56. Additionally, the proportional valve elements of head-end and rod-end supply valves 32, 34 may be controlled by control system 100 to vary the size of a flow area through which the pressurized fluid may flow. It is contemplated that head-end supply valve 32 may alternately be hydraulically actuated, mechanically actuated, pneumatically actuated, or actuated in any other suitable manner. It is noted that proportional valve elements may provide increased flexibility in the control of the movement of hydraulic actuator 18 over that of fixed area valve elements, because, for example, different flow rates of fluid may be necessary and/or desired to be supplied to first and second chambers 54, 56 to establish different actuation speeds of first hydraulic actuator 18 based on varying external forces acting thereon and/or different operator inputs.

Head-end and rod-end drain valves 36, 38 may be disposed between first hydraulic actuator 18 and tank 28 and may be configured to regulate a flow of pressurized fluid from first and second chambers 54, 56. Specifically, head-end and rod-end drain valves 36, 38 may each include a two-position valve element that may be spring biased and solenoid actuated between a first position at which fluid may be allowed to flow from first and second chambers 54, 56 and a second position at which fluid may be substantially blocked from flowing from first and second chambers 54, 56. It is contemplated that head-end and rod-end drain valves 36, 38 may include additional or different valve elements such as, for example, a proportional valve element and/or any other valve mechanism known in the art. It is also contemplated that head-end and rod-end drain valves 36, 38 may alternately be hydraulically actuated, mechanically actuated, pneumatically actuated, and/or actuated in any other suitable manner.

Head-end and rod-end supply and drain valves 32, 34, 36, 38 may be fluidly interconnected. In particular, head-end and rod-end supply valves 32, 34 may be connected in parallel to upstream supply passageway 60 and connected to a downstream system signal passageway 62. Head-end and rod-end drain valves 36, 38 may be connected in parallel to a downstream drain passageway 64. Head-end supply and return valves 32, 36 may be connected in parallel to a first chamber passageway 61, and rod-end supply and return valves 34, 38 may be connected in parallel to a second chamber passageway 63.

Head-end and rod-end makeup valves 40, 44 may be fluidly connected to first and second chamber passageways 61, 63 between first hydraulic actuator 18 and head-end and rod-end supply and drain valves 32, 34, 36, 38. Head-end and rod-end makeup valves 40, 44 may each have a valve element configured to allow fluid from tank 28 into first and second chamber passageways 61, 63 in response to a fluid pressure within first and second chamber passageways 61, 63 being below a pressure of the fluid within tank 28. In this manner, head-end and rod-end makeup valves 40, 44 may be configured to reduce a drop in pressure within hydraulic system 24 caused by external forces acting on first hydraulic actuator 18 by allowing fluid from tank 28 to fill first and second chambers 54, 56.

Head-end and rod-end pressure relief valves 42, 46 may be fluidly connected to first chamber and second passageways 61, 63 between first hydraulic actuator 18 and head-end and rod-end supply and drain valves 32, 34, 36, 38. Head-end and rod-end pressure relief valves 42, 46 may each have a valve element spring biased toward a valve closing position and movable to a valve opening position in response to a pressure within first and second chamber passageways 61, 63 being above a predetermined pressure. In this manner, head-end and rod-end pressure relief valves 42, 46 may be configured to reduce a pressure spike within hydraulic system 24 caused by external forces acting on first hydraulic actuator 18 by allowing fluid from first and second chambers 54, 56 to drain to tank 28.

Shuttle valve 74 may be disposed within downstream system signal passageway 62. Shuttle valve 74 may be configured to fluidly connect the one of head-end and rod-end supply valves 32, 34 having a lower fluid pressure to pressure compensating valve 30 in response to a higher fluid pressure from the other of head-end or rod-end supply valves 32, 34. In this manner, shuttle valve 74 may resolve pressure signals from head-end and rod-end supply valves 32, 34 to allow the lower outlet pressure of the two valves to affect movement of pressure compensating valve 30 via fluid passageway 82.

Hydraulic system 24 may include additional components to control fluid pressures and/or flows within hydraulic system 24. Specifically, hydraulic system 24 may include pressure balancing passageways 66, 68 configured to control fluid pressures and/or flows within hydraulic system 24. Pressure balancing passageways 66, 68 may fluidly connect upstream supply passageway 60 and downstream system signal passageway 62. Pressure balancing passageways 66, 68 may include restrictive orifices 70, 72, respectively, to minimize pressure and/or flow oscillations within fluid passageways 66, 68. It is contemplated that restrictive orifices 70, 72 may be omitted, if desired. Hydraulic system 24 may also include a check valve 76 disposed between pressure compensating valve 30 and upstream supply passageway 60 and may be configured to block pressurized fluid from flowing from upstream supply passageway 60 to pressure compensating valve 30.

Control system 100 may be configured to control the operation of head-end and rod-end supply valves 32, 34 and source 26. Control system 100 may include a controller 102 configured to receive pressure signals from head-end and rod-end pressure sensors 108, 110 via communication lines 104, 106. Controller 100 may also be configured to deliver control signals to head-end and rod-end supply valves 32, 34 via communication lines 112, 114 and deliver a control signal to source 26 via communication line 116. It is contemplated that the pressure and control signals may each be any conventional signal, such as, for example, a pulse, a voltage level, a magnetic field, a sound or light wave, and/or another signal format.

Controller 102 may be configured to control head-end and rod-end supply valves 32, 34 and source 26 in response to the pressure signals received from head-end and rod-end pressure sensors 108, 110. Controller 102 may be configured to perform one or more algorithms to determine appropriate output signals to control the movement of the valve elements of, and thus the amount of flow directed through, head-end and rod-end supply valves 32, 34 and to control the output, e.g., output pressure and/or output flow rate, of source 26. Controller 102 may determine the appropriate control signals by, for example, predetermined equations, look-up tables, and/or maps. It is contemplated that controller 102 may include one or more microprocessors, a memory, a data storage device, a communications hub, and/or other components known in the art. It is also contemplated that controller 102 may be configured as a separate controller or be integrated within a general work machine control system capable of controlling various additional functions of work machine 10. It is further contemplated that controller 102 may control the operation of other components within hydraulic system 24, such as, for example, head-end and rod-end drain valves 36, 38.

Head-end and rod-end pressure sensors 108, 110 may include any known pressure sensor and may be configured to sense the pressure of the pressurized fluid supplied to first and second chambers 54, 56 and establish a appropriate pressure signal indicative of the sensed pressure. It is contemplated that the pressure signals may be determined from any location downstream of head-end and rod-end supply valves 32, 34, such as, for example, within a respective first and second chamber 54, 56, within first and second chamber passageways 61, 63, and/or any other suitable location. It is contemplated that any number of pressure sensors may be disposed within hydraulic system 24 each configured to generate a pressure signal that may be used by controller 102 to determine an appropriate control signal for head-end and rod-end supply valves 32, 34 and source 26 by, for example, combining the pressure signals thereof via a predetermined algorithm into a single pressure signal and/or using a plurality of look-up tables to interrelate the plurality of pressure signals.

INDUSTRIAL APPLICABILITY

The disclosed hydraulic system may be applicable to any work machine that includes one or more fluid actuators where control of pressures and/or flows of fluid supplied to hydraulic actuators is required. In particular, the disclosed hydraulic system may reduce pressure surges therein while reducing pressure drops across the components thereof. The disclosed hydraulic system may also be capable of adjusting to changing loads on the actuators and correspondingly different demands on a source of pressurized fluid. The operation of hydraulic system 24 is explained below. It is understood that the operation of hydraulic system 24 will be explained with reference to first hydraulic actuator 18 for clarification purposes only and that the explanation thereof is also applicable to any additional hydraulic circuits 200 configured to actuate second hydraulic actuator 20 and/or additional hydraulic actuators.

First hydraulic actuator 18 may be movable by fluid pressure in response to an operator input. Fluid may be pressurized by source 26 and directed to head-end and rod-end supply valves 32, 34 via upstream supply passageway 60. In response to an operator input to either extend or retract piston assembly 52 relative to tube 50, controller 102 may control one of head-end and rod-end supply valves 32 and 34 to move from a flow blocking position to a flow passing position to direct pressurized fluid to the appropriate one of first and second chambers 54, 56. Substantially simultaneously, one of head-end and rod-end drain valves 36, 38 may move from a flow blocking position to a flow passing position to direct fluid from the appropriate one of the first and second chambers 54, 56 to tank 28 to create a pressure differential across piston assembly 52 that causes piston assembly 52 to move relative to tube 50. It is contemplated that the proportional valve element of the one of head-end and rod-end supply valves 32, 34 in a flow passing position may be controlled to any one of the plurality of positions thereof to establish any desired flow of pressurized fluid therethrough. It is noted that the amount of flow supplied to first hydraulic actuator 18 may be proportional to the speed at which first hydraulic actuator 18 moves, e.g., a position of one of head-end and rod-end supply valves 32, 34 allowing a relatively larger flow may actuate hydraulic actuator 18 at a greater speed as compared to a position allowing a relatively smaller flow. It is also contemplated that the position of the valve element of the one of head-end and rod-end supply valves 32, 34 in a flow passing position may be determined, for example, by controller 102 relating operator inputs with desired flow passing positions via a look-up table to provide a desired amount of fluid at a desired flow rate to appropriately move first hydraulic actuator 18. It is further contemplated that the valve element of the one of head-end and drain-end drain valves 36, 38 may be determined, for example, by controller 102 relating operator inputs and/or the pressure differential across piston assembly 52 with desired flow passing positions to provide a desired amount of fluid at a desired flow rate to establish an appropriate resistance to movement of hydraulic actuator 18.

As one of head-end and rod-end supply valves 32, 34 is moved to a flow passing position, pressure within downstream system signal passageway 62 on the flow passing valve side of shuttle valve 74 may be lower than the pressure of the fluid within the downstream system signal passageway 62 on the flow blocking side of shuttle valve 74. As a result, shuttle valve 74 may be biased by the higher pressure toward the flow passing valve, thereby communicating the lower pressure from the flow passing valve and one of the fluid passageways 66, 68 to pressure compensating valve 30 via passageway 82. This lower pressure communicated to pressure compensating valve 30 may then act together with the force of the spring against the pressure communicated to pressure compensating valve 30 from fluid passageway 78. The resultant force may then either move the valve element of pressure compensating valve 30 toward a flow blocking or flow passing position. As the pressure from source 26 drops, due to, for example, decreasing demands thereon as a result of lower external forces acting on one or more of the actuators and/or changing operator inputs to establish different operations, pressure compensating valve 30 may move toward the flow passing position and thereby maintain the pressure within upstream supply passageway 60. Similarly, as the pressure from source 26 increases, due to, for example, increasing demands thereon as a result of higher external forces acting on one or more of the actuators and/or changing operator inputs to establish different operations, pressure compensating valve 30 may move toward the flow blocking position to thereby maintain the pressure within upstream supply passageway 60. In this manner, pressure compensating valve 30 may regulate the fluid pressure within hydraulic system 24 by establishing an appropriate pressure drop to control the pressure in upstream supply passageway 60 to a substantially constant pressure so as to establish and maintain a desired load pressure on first hydraulic actuator 18, regardless of the output pressure of source 26, for a given operation.

The pressure drop across pressure compensating valve 30 may vary depending on the pressure output of source 26 and the load pressure associated with actuation of first hydraulic actuator 18 because source 26 may supply pressure to multiple hydraulic actuators each having a different load pressure. For example, a first operator input may only command the actuation of first hydraulic actuator 18 demanding a first pressure from source 26, whereas a subsequent operator input may command the actuation of first hydraulic actuator 18 and second hydraulic actuator 20 demanding a second pressure from source 26 higher than the first pressure. The pressure drop across the one of head-end and rod-end supply valves 32, 34 in a particular flow passing position, however, may be substantially constant because pressure compensating valve 30 maintains pressure within upstream supply passageway 60 at a substantially constant pressure. For example, the pressure drop across head-end supply valve 32 may, for a desired operation, be approximately 2 MPa. For the same desired operation, the pressure output of source 26 may be, for example, approximately 20 MPa and the load pressure for first hydraulic actuator 18 may be, for example, approximately 10 MPa. As such, the valve element of pressure compensating valve 30 may be actuated to a position resulting in a pressure drop of, for example, approximately 8 MPa across pressure compensating valve 30. Additionally, for a different operation, the pressure output of source 26 may be, for example, approximately 30 MPa and the load pressure for first hydraulic actuator 18 may remain at, for example, approximately 10 MPa. As such, the valve element of pressure compensating valve 30 may be actuated to a position resulting in a pressure drop of, for example, approximately 18 MPa across pressure compensating valves 30.

Figure 3:
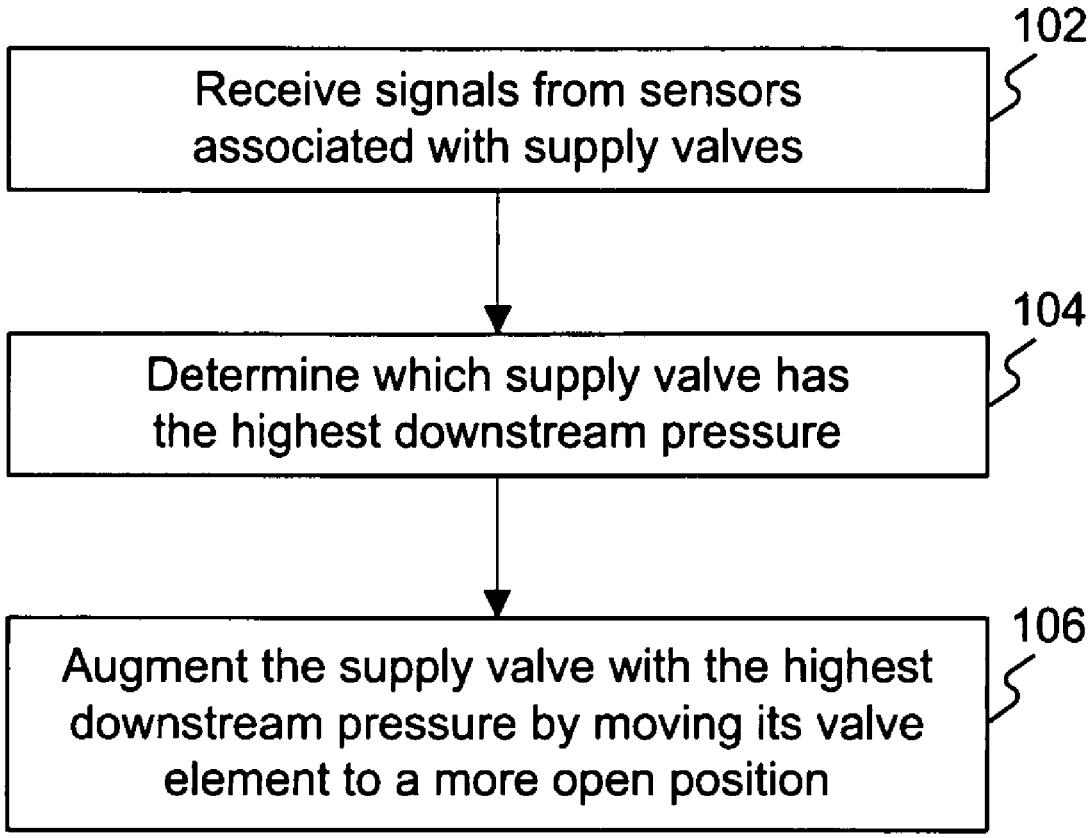
FIG. 3 is a flow chart illustrating an exemplary disclosed method of operating the hydraulic system of FIG. 2.

In multi-function operations, such as when, for example, multiple hydraulic actuators, e.g., first and second hydraulic actuators 18, 20 are desired to be operated, controller 102 may control multiple head-end and rod-end supply valves, e.g., head-end and rod-end valves 32, 34, to be actuated to flow passing positions to direct pressurized fluid to respective chambers, e.g., first and second chambers 54, 56, of the multiple hydraulic actuators, as illustrated in the flow chart of FIG. 3. Controller 102 may receive multiple pressure signals from multiple head-end and rod-end pressure sensors, e.g., head-end and rod-end pressure sensors 108, 110, associated with the multiple flow passing supply valves (step 102). The one of such multiple flow passing supply valves having the highest downstream pressure, may be augmented, e.g., the one of such multiple flow passing supply valves associated with the highest load pressure of an associated hydraulic actuator. Specifically, one of the multiple flow passing supply valves may have a pressure downstream thereof that is greater than the pressure downstream of the other ones of the multiple flow passing supply valves. Controller 102 may determine the highest pressure flow passing supply valve by, for example, comparing signals received from the multiple pressure sensors 108, 110 (step 104). Controller 102 may augment the highest pressure flow passing supply valve by increasing the displacement of its proportional valve element toward a more open position (step 106). For example, the displacement of its proportional valve element, as determined by the controller 102 via, for example, a respective look-up table, may be augmented to lower the pressure of the flow of pressurized fluid therethrough.

Because the highest pressure supply valve may be augmented, the overall pressure demand on source 26 may be reduced. For example, considering that head-end supply valve 32 may be, for a desired operation, the highest pressure supply valve, pressure compensating valve 30 may maintain a constant pressure drop between source 26 and first hydraulic actuator 18. By augmenting head-end supply valve 32, the pressure differential between upstream supply passageway 60 and first chamber passageway 61 may be reduced. Consequently, the pressure supplied to the flow passing valve side of shuttle valve 74 may be reduced resulting in a lower pressure being communicated to pressure compensating valve 30 via passageway 82. This lower pressure may then affect the balance of the proportional valve element of pressure compensating valve 30 to a more closed position. However, because the pressure drop from upstream supply passageway 60 to first chamber passageway 61 has been reduced, less pressure may be required from source 26. Thus, the demand on source 26 may be reduced. As such, the controller may 102 may either reduce the output pressure of source 26, which may, in turn, reduce the required output of the power source drivably connected to source 26 or permit source 26 to output an increased flow of pressurized fluid. For example, as is known in the art, sources of pressurized fluid may output pressurized fluid at various pressures and flow rates, wherein output pressure is inversely proportional to output flow rate and, because of physical limitations, may have an output demand limit. As a result of reducing the output pressure of source 26 by augmenting head-end supply valve 32, source 26 may require less energy to supply the same output flow rate at the reduced output pressure or may be capable of supplying an increased output flow rate at the reduced output pressure, thus supplying more flow of pressurized fluid to first hydraulic actuator 18. It is noted that an increase in output flow rate of source 26 may be directed to the actuator associated with the highest pressure supply valve because, for example, the actuators associated with the non-highest pressure supply valves may have sufficient flow to affect movement thereof against the relatively low resistive forces acting thereon.

It is contemplated that for different operator inputs selectively actuating multiple hydraulic actuators, the highest pressure supply valve of hydraulic system 24 may change. It is also contemplated that the highest pressure supply valve may depend, for example, in part on the number of actuators moved, the degree of movement of each actuator, the type of actuator moved, the particular group of actuators moved, and/or other actuator movement configurations. As such, because head-end and rod-end supply valves 32, 34 are proportional valves, each of the valve elements can be augmented as necessary and/or as desired which may provide flexible control of hydraulic system 24 as the highest pressure supply valve changes. For example, proportional area valve elements may allow different flow rates of fluid to be supplied to first and second chambers 54, 56 to establish different actuation speeds of first hydraulic actuator 18, which may adapt to varying external forces acting on first hydraulic actuator 18 and/or different desired operator inputs. It is also contemplated that the displacement of the proportional valve element of the augmented highest pressure flow passing supply valve may be increased by any amount above the displacement determined from a respective look-up table to a fully opened valve position. It is further contemplated that the flow passing position of the drain valve associated with the augmented highest pressure flow passing supply valve may not be adjusted as a function of the decreased pressure so as to maintain the appropriate resistance to the movement of the associated hydraulic actuator.

Additionally, in multi-function operations, one or more hydraulic circuits may have substantially the same pressure and/or may have pressures within a predetermined range. As such, each of the flow passing supply valves associated with the substantially the same pressure may be augmented. It is contemplated that in multi-function operations, one or more hydraulic actuators may not be actuated. As such, the pressure value associated with inactive hydraulic actuators may be defaulted to zero. It is also contemplated that in single-function operations of multiple hydraulic actuator systems, such as when, for example, only one hydraulic actuator is desired to be operated, the flow passing supply valve may be augmented in a similar manner as the highest pressure flow passing supply valve in a multi-function operation. It is further contemplated that controller 102 may selectively not augment the highest pressure flow passing valve for particular operations of hydraulic system 24, such as, for example, when controller 102 selectively controls hydraulic system 24 to regenerate a portion of the pressurized fluid directed toward tank 28 from one of first and second chambers 54, 56 to the other one of first and second chambers 52, 54 by, for example, opening both head-end and rod-end supply valves 32, 34 to allow pressurized fluid from one of first and second chambers 54, 56 to combine with pressurized fluid from source 26 within upstream supply passageway 60.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system comprising:

a source of pressurized fluid;

a first hydraulic circuit having a first hydraulic actuator, a first valve, and a first pressure compensating valve disposed between the source and the first valve;

a second hydraulic circuit having a second hydraulic actuator, a second valve and a second pressure compensating valve disposed between the source and the second valve; and the first valve having a first valve element movable relative to a first valve bore between a plurality of positions from a first position in which pressurized fluid is substantially blocked from flowing toward the first hydraulic actuator to a second position in which a maximum flow of pressurized fluid is allowed to flow toward the first hydraulic actuator, the first valve element being configured to be selectively moved from a third flow passing position located between the first and second positions to a fourth flow passing position disposed between the third and second positions independent of a corresponding movement of the second valve when a sensed pressure of pressurized fluid directed toward the first hydraulic actuator is greater than the pressurized fluid directed toward the second hydraulic actuator, the movement of the first valve to the fourth position being a function of the sensed pressure;

wherein the first hydraulic actuator includes a plurality of chambers; and the first valve is one of a first set of valves, each valve of the first set of valves configured to be independently controlled with respect to the other valves of the first set of valves to affect a flow of pressurized fluid with respect to a single one of the plurality of chambers.

2. The hydraulic system of claim 1, wherein the second valve includes a second valve element movable relative to a second valve bore between a plurality of positions from a first position in which pressurized fluid is substantially blocked from flowing toward the second hydraulic actuator to a second position in which a maximum flow of pressurized fluid is allowed to flow toward the second hydraulic actuator; and wherein the first valve element is configured to be moved from the third position to the fourth position when a pressure downstream of the first valve is greater than the pressure downstream of the second valve.

3. The hydraulic system of claim 2, wherein the source of pressurized fluid is a variable displacement pump configured to supply pressurized fluid at substantially the same pressure toward the first and second valves.

4. The hydraulic system of claim 1, wherein the first valve further includes a flow area configured to control the flow of pressurized fluid through the first valve and movement of the first valve element relative to the first valve bore proportionally changes a flow area, the hydraulic system further including:

a controller configured to affect movement of the first valve element relative to the first valve bore to proportionally change the flow area; and at least one pressure sensor configured to sense a pressure of pressurized fluid downstream of the first valve.

5. The hydraulic system of claim 4, wherein the controller selectively moves the first valve element from the third position to the fourth position in response to the sensed pressure.

6. The hydraulic system of claim 1, further including:

additional hydraulic circuits each having a hydraulic actuator and a valve;

wherein the flow area of the one of the first, second, or additional valves having the highest pressure downstream thereof is augmented independently from the remaining ones of the first, second, and additional valves.

* * * * *